US005591071A

United States Patent [19]

Shin et al.

[11] Patent Number: 5,591,071

[45] Date of Patent: Jan. 7, 1997

[54] POLISHING DEVICE

[75] Inventors: Shoichi Shin; Masafumi Tsunada; Yasuhiko Nagakura; Toshio Oishi, all of Shizuoka-ken, Japan

[73] Assignee: Toshiba Kikai Kabushiki Kaisha, Tokyo, Japan

[21] Appl. No.: 329,130

[22] Filed: Oct. 24, 1994

[30] Foreign Application Priority Data

Oct. 25, 1993 [JP] Japan ..... 5-288614
Nov. 2, 1993 [JP] Japan ..... 5-063619 U

[51] Int. Cl.[6] ..... B24B 55/00

[52] U.S. Cl. ..... 451/276; 451/451

[58] Field of Search ..... 451/274, 285, 451/287, 289, 290, 41, 276, 288, 451

[56] References Cited

U.S. PATENT DOCUMENTS 639,995 12/1899 Warner ..... 451/450
5,441,444 8/1995 Nakajima ..... 451/289

FOREIGN PATENT DOCUMENTS 3010805 9/1980 Germany ..... 451/288
6119366 9/1981 Japan ..... 451/288
8126063 7/1983 Japan ..... 451/288

*Primary Examiner*—Robert A. Rose
*Attorney, Agent, or Firm*—Fish & Richardson P.C.

[57] ABSTRACT

A polishing device includes a rotatable first column vertically provided at the lateral side of a surface table. A second column engages the first column so as to be able to be moved up and down by a lifting drive (air cylinder). The second column is provided with an arm, to which a polishing head is fitted. The surface table, first column and polishing head are driven by directly connected or built-in motors M1, M2 and M3.

5 Claims, 3 Drawing Sheets

POLISHING DEVICE

FIELD OF THE INVENTION

This invention relates to a device for polishing work such as a semiconductor wafer and, more particularly, to a polishing device which allows a countermeasure against the production of dust due to polishing and an improvement in the accuracy of polishing to be planned.

BACKGROUND OF THE INVENTION

The polishing device is so constituted that while a surface table for polishing is rotated, a work such as a semiconductor wafer is mounted on a polishing head provided opposite the surface table so as to be rotated, the surface of the work is pressed against the surface of the surface table, and the polishing head is moved radially of the surface table, thereby polishing the entire surface of the work more uniformly.

In the conventional polishing device, the polishing head is fitted to a swing arm for up and down motion, and is moved up and down by means of a lifting drive secured to the swing arm, while a force pressing the work against the surface table is controlled. Rotation of the polishing head is given by way of a rotation transmitting mechanism such as a belt or the like which also serves as a reduction mechanism, from a motor provided on the swing arm or a frame to which the swing arm is secured. Rotation of the surface table and swing of the swing arm are performed by way of a reduction and rotation transmitting mechanism such as a belt or gears from a motor.

The construction of the polishing head being fitted to the swing arm for up and down motion, has a disadvantage in that since the relative movable parts are positioned near the surface table, there is a high possibility of the work such as a semiconductor wafer or the like being contaminated by dust produced due to wear of the metal, and also from a view point of the entire device, it has a disadvantage in the production of dust being apt to be released in the air, thereby providing a high possibility of contaminating the surroundings.

SUMMARY OF THE INVENTION

Accordingly, it is an object of the invention to provide a polishing device which makes it possible to reduce the amount of dust released from the device into the atmosphere and to plan an improvement in the accuracy of polishing.

In order to achieve the above-mentioned object, according to the invention, there is provided a polishing device which comprises:

a surface table for polishing arranged horizontally;

a means for driving in rotation the surface table;

a polishing head arranged for rotation above the surface table in opposite relation thereto;

an arm for rotatably supporting the polishing head;

a means for driving in rotation the polishing head;

a polishing head lifting means for driving in up and down motion the polishing head relative to the surface table; and an arm swinging means for swinging the arm in the horizontal plane, said surface table rotation drive means and said polishing head rotating means being arranged with their outer periphery closed in a sealed condition.

Since the rotation drive means for the surface table and polishing head are arranged with their outer periphery closed in a sealed condition according to the invention, dust produced at the time of their rotation drive is prevented from scattering into the surroundings of the polishing device to contaminate the work and the atmosphere.

BRIEF DESCRIPTION OF THE DRAWINGS

Other objects and aspects of the invention will be apparent from the following description of embodiments with reference to the accompanying drawings in which.

DETAILED DESCRIPTION OF THE EMBODIMENT

Figure 1:
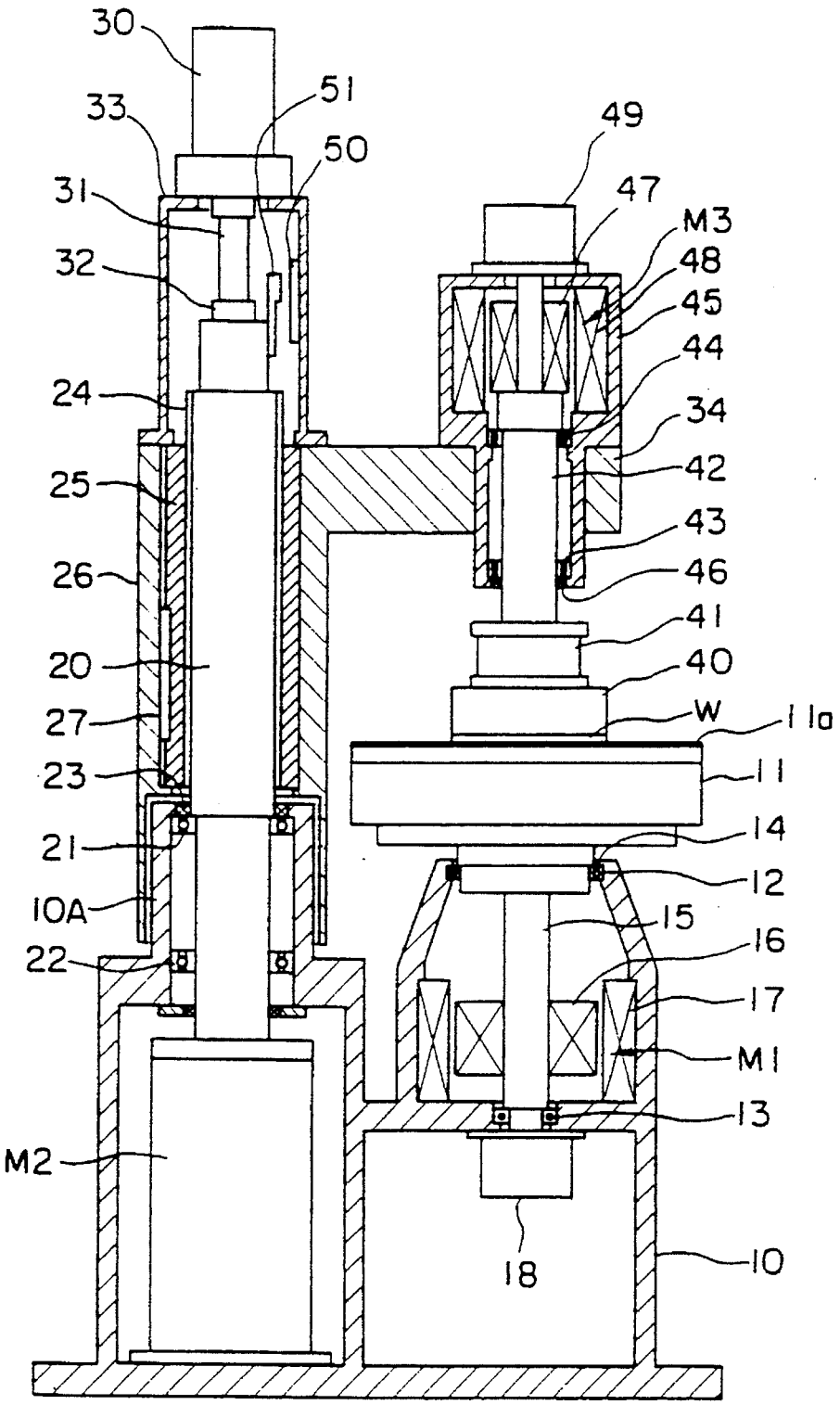
FIG. 1 is a longitudinal sectional view showing a first embodiment of the present invention.

Now, an embodiment of the present invention will be explained with reference to FIG. 1. A surface table 11, to the surface of which an abrasive cloth 11*a* is applied, is rotatably fitted to a frame 10 by means of bearings 12 and 13. The opening at the end of the frame 10 is sealed by means of a seal member 14. A rotor 16 forming a part of a motor M1 for the surface table is mounted on a shaft 15 of the surface table 11 and a stator 17, which makes a pair with the rotor 16, is secured to the frame 10, thereby forming a built-in type motor M1. A rotary encoder 18 for detection of the number of revolutions is connected to the lower end of the shaft 15.

A motor M2 for swing is vertically provided on the frame 10 to the left of the surface table 11. A cylindrical first column 20 is directly connected to the output shaft of the motor M2. The first column 20 is only rotatably fitted to the frame 10 by means of bearings 21 and 22. The opening at the end of the cylindrical projection 10A is sealed by a seal member 23.

On the outer circumferential surface of the first column 20 are provided spline grooves 24, onto which a ball spline 25 is fitted. The ball spline 25 is secured to the inside of a cylindrical hollow second column 26 to fit the second column 26 for up and down motion relative to the first column 20. Reference character 27 indicates a key for preventing a relative rotation between the ball spline 25 and the second column 26. The second column 26 is formed to have a length to such a degree that it covers the exposed portion above the seal member 23 of the first column 20 substantially over the entire length thereof, and when the lower end of the second column 26 is positioned near the lower limit as shown in FIG. 1, it is adapted to cover the cylindrical projection 10A of the frame 10 which supports the bearing 21.

A piston rod 31 of an air cylinder 30 as a lifting drive is secured to the top end of the first column 20 through a load cell 32 as a load sensor. The second column 26 is connected at the top end thereof to the air cylinder 30 through a connecting tube 33. The upper end portion of the first column 20 is covered by the second column 26, connecting tube 33 and air cylinder 30.

An arm 34 is integrally formed on the upper portion of the second column 26. The arm 34 is positioned upwardly of the surface table 11 and has a polishing head 40 attached thereto opposite the surface table 11. The polishing head 40 is fitted to the lower end of a shaft 42 through a universal joint 41, and the shaft 42 is rotatably mounted on the arm 34 through the bearings 43, 44 and a casing 45. Further, the opening at the end of the casing 45 is sealed by means of a seal member 46.

A rotor 47 forming a part of a motor M3 for the polishing head is mounted on the shaft 42, and a stator 48, which makes a pair with the rotor 47, is fitted to the casing 45, thereby forming a so-called built-in type motor M3. Further, to the top end of the shaft 42 is connected a rotary encoder 49 for detecting the number of revolutions.

A high resolution type optical scale 50 is attached to the interior of the connecting tube 33 along the vertical direction, and a reading head 51 is attached to the top end of the first column 20.

Now, the operation of the device will be explained. When the air cylinder 30 is actuated to move the piston rod 31 forward, the air cylinder 30 is moved upwardly, so that the second column 26 is moved upwardly along the first column 20 through the connecting tube 33 by help of the ball spline 25, thereby moving upward the polishing head 40 fitted to the arm 34. The work W, such as a semiconductor wafer or the like, is attached to the lower surface of the polishing head 40 which is in such a lifted condition.

The air cylinder 30 is actuated to move down the connecting tube 33. Downward movement of the connecting tube 33 causes the second column 26 to be moved downwardly along the spline grooves 24 of the first column 20 by help of the ball spline 25, thereby moving the polishing head 40 downward, as shown in FIG. 1. This downward movement brings the surface of the work W (lower surface in FIG. 1) held on the polishing head 40 into contact with the abrasive cloth 11*a* on the surface table 11.

A force pressing the work W against the abrasive cloth 11*a* is set and controlled to a proper value by taking the output of the load cell 32 provided on the lower end of the piston rod 31 into a control device (not shown) and controlling the pressure of compressed air supplied to the air cylinder 30 by means of the control device.

Subsequently, the motors M1 and M3 are operated so that they are rotated at their predetermined revolutions on the basis of signals of the rotary encoders 18 and 49, thereby rotating the surface table 11 and the polishing head 40 at their predetermined speeds. At this time, a polishing liquid is supplied to the abrasive cloth 11*a* on the surface table 11; however, such an operation is similar to a known one and, so, illustration and explanation thereof are omitted in the present embodiment.

Along with the application of the pressure of the work W against the abrasive cloth 11*a*, the motor M2 for swing is operated so that the first column 20 is rotated in reciprocating motion through a predetermined range of angle and at a predetermined speed. This causes the arm 34 to be swung, so that the polishing head 40 is moved in reciprocating motion along the upper surface of the surface table 11 in the radial direction passing substantially through the center thereof, thereby causing the surface of the work W to be polished by the abrasive cloth 11*a*.

Since the rotation of the surface table 11 and polishing head 40 and the rotation of the first column 20, i.e., swing of the polishing head 40 are performed by means of the directly connected or built-in motors M1, M2 and M3 without interposing any rotation transmitting mechanism such as a belt, gears or the like, dust is hardly produced and, simultaneously, vibration is scarcely caused, thereby allowing a polishing operation to be performed with a high degree of accuracy.

Further, since the vertically movable portions, where dust is apt to be produced, exist within the second column 26 away from the surface table 11 and are covered by the second column 26, connecting tube 33 and air cylinder 30, even if dust is produced from the vertically movable portions, there is little possibility of it contaminating the work W and, besides, the release of such dust into the air is reduced to a minimal degree. In order to suppress the release of dust into the air completely, it is preferable to perform positive exhaust from each of the spaces such as the interior of the connecting tube 33 and the like to cause air to circulate.

The polished amount of the work W is detected in such a manner that the value detected by the reading head 51 of the optical scale 50 at the time of beginning a polishing operation is kept stored in the control device, and the amount of downward motion of the second column 26 from the above-mentioned detected value, i.e., the amount of downward motion of the polishing head 40 is detected by means of a position measuring device consisting of the optical scale 50 and the reading head 51. Such a measurement of the polished amount can be carried out with a minimum unit of 0.05 μm using a high resolution type optical scale 11; however, it is not limited to the optical scale 11, but various kinds of measuring devices such as a laser interference-type length measuring equipment or the like can be used.

When the polished amount has reached a predetermined one, the control device causes the polishing head to be moved upward through the second column 26 and the arm 34 by the air cylinder 30, thus completing the polishing operation.

Figure 2:
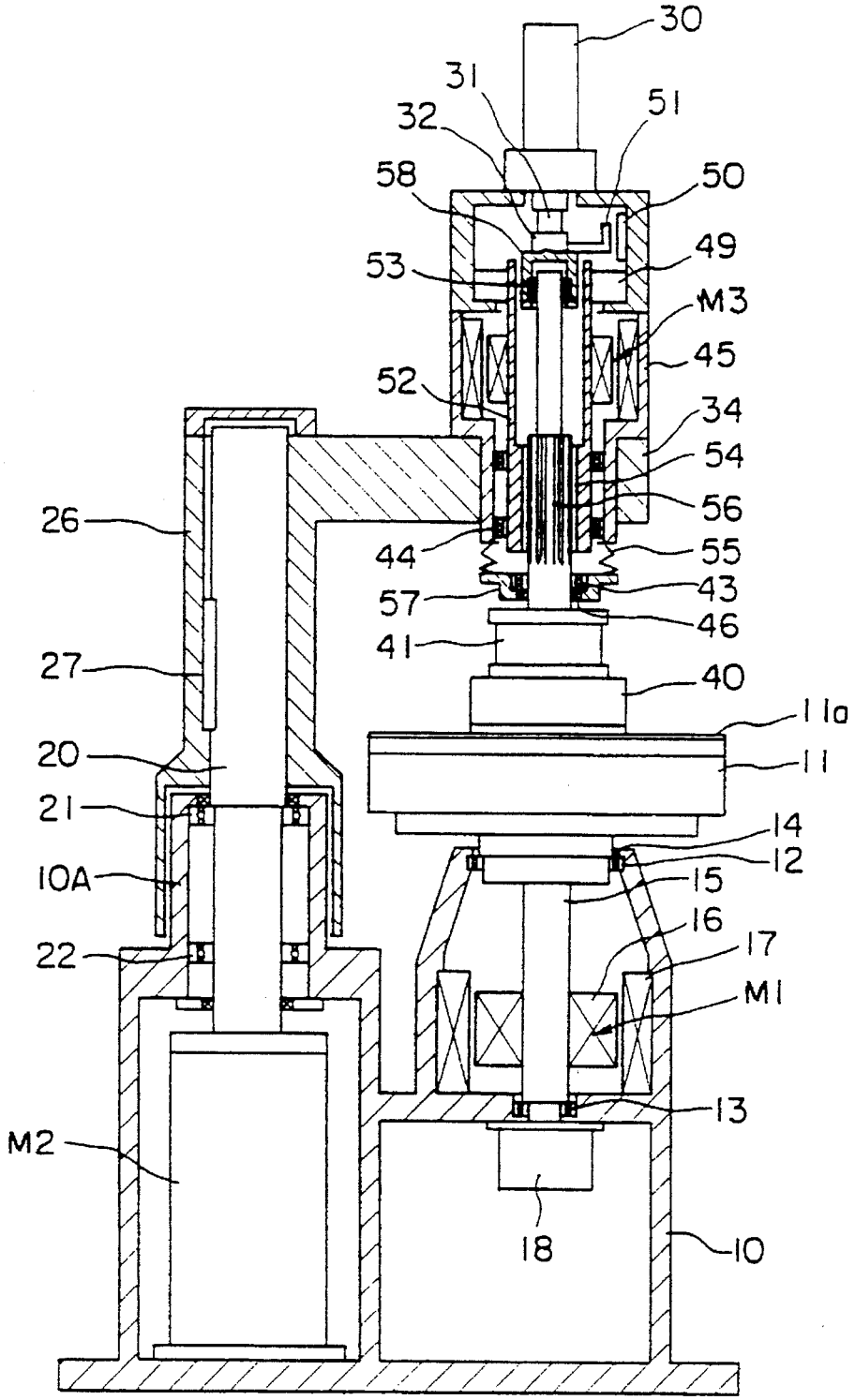
FIG. 2 is a longitudinal sectional view showing a second embodiment of the invention.

FIG. 2 is a longitudinal sectional view showing a second embodiment of the invention. The present embodiment is different from the above-mentioned embodiment in that the drive mechanism for moving the polishing head 40 upward is provided directly on the upward portion of the polishing head 40. The structural parts, which are the same as those in the above-described embodiment, are indicated with the same reference characters and, so, the explanation thereof is omitted.

A hollow shaft 52 is rotatably supported concentrically with the hollow casing 45 by means of bearings 44 within the hollow casing 45 secured to the arm 34. The hollow shaft 52 is formed with a spline 54 on the inner peripheral surface thereof, and a spline shaft 56 having a spline engaging the spline 54 is inserted into the hollow shaft 52 for sliding motion in the axial direction.

At the lower end of the spline shaft 56 is connected the polishing head 40 through the universal joint 41, and the spline shaft 56 is rotatably supported at the upper and lower portions thereof by means of the bearings 43 and 53.

The support bearing 43 at the lower end of the spline shaft 56 is held within a bearing cover 57 suspended downwardly of the hollow casing 45, by a bellows cover 55 which also serves as a dust guard cover. Moreover, the support bearing 53 at the upper end is a bearing which enables a thrust load to be supported, and it is held within a hollow cylindrical bearing cover 58 secured to the lower portion of the piston rod 31 of the air cylinder 30 through the load cell 32.

The air cylinder 30 is secured to the top end of the hollow casing 45 so that the piston rod 31 exists on the same axis as that of the spline shaft 56.

The optical scale 50 is attached to the inner surface of the upper portion of the hollow casing 45 along the vertical direction, and the reading head 51 for reading the optical scale 50 is secured to a bearing cover 58 fitted to the lower portion of the piston rod 31.

In the present embodiment as constituted above, the polishing head 40 is driven in rotation by the motor M3 through the spline shaft 56 and the hollow shaft 52. Further, the air cylinder 30 is actuated to move the piston rod 31 upwardly, so that the spline shaft 56 is directly moved up and down through the bearing cover 58, thereby moving the polishing head 40 up and down. The other operation is similar to that of the above-described embodiment.

Since, in the present embodiment, the air cylinder 30, which drives the polishing head 40 in an up and down motion, is connected directly to the upper portion of the polishing head 40, it is possible to make the necessary driving force of the air cylinder 30 smaller and to make the device smaller in size. In addition, since the polishing head 40 is directly operated in an up and down motion without moving the arm 34 vertically, control of the vertical position of the polishing head 40 is easy and, so, an improvement in the accuracy of polishing can be planned.

Moreover, since the spline shaft 56 is covered by the dust guard cover 55, fine powder is prevented from entering the sliding portion of the spline shaft 56 during a polishing operation and, simultaneously, the fine powder produced in the motor M3 and other rotating or sliding portions is prevented from falling onto the surface table 11.

In the afore-mentioned embodiment, an example in which the built-in type motors M1 and M3 are used as motors for driving in rotation the surface table 11 and polishing head 40 is shown; however, also in the case where separate motors are directly connected to the shafts 15 and 42, similarly to the motor M2 for rotation of the first column 20, similar advantageous effects are provided. Further, the lifting drive for the polishing head 40 is not limited to the air cylinder 30, but various kinds of driving devices such as a hydraulic motor, an electric servo motor or the like can be used. Moreover, the above-mentioned embodiment shows a one-sided polishing device which polishes only the surface (lower surface) of the work W; however, the present invention is not limited to such a device, but is applicable also to a dual-sided polishing device by using an upper surface table as the polishing head 40.

Figure 3:
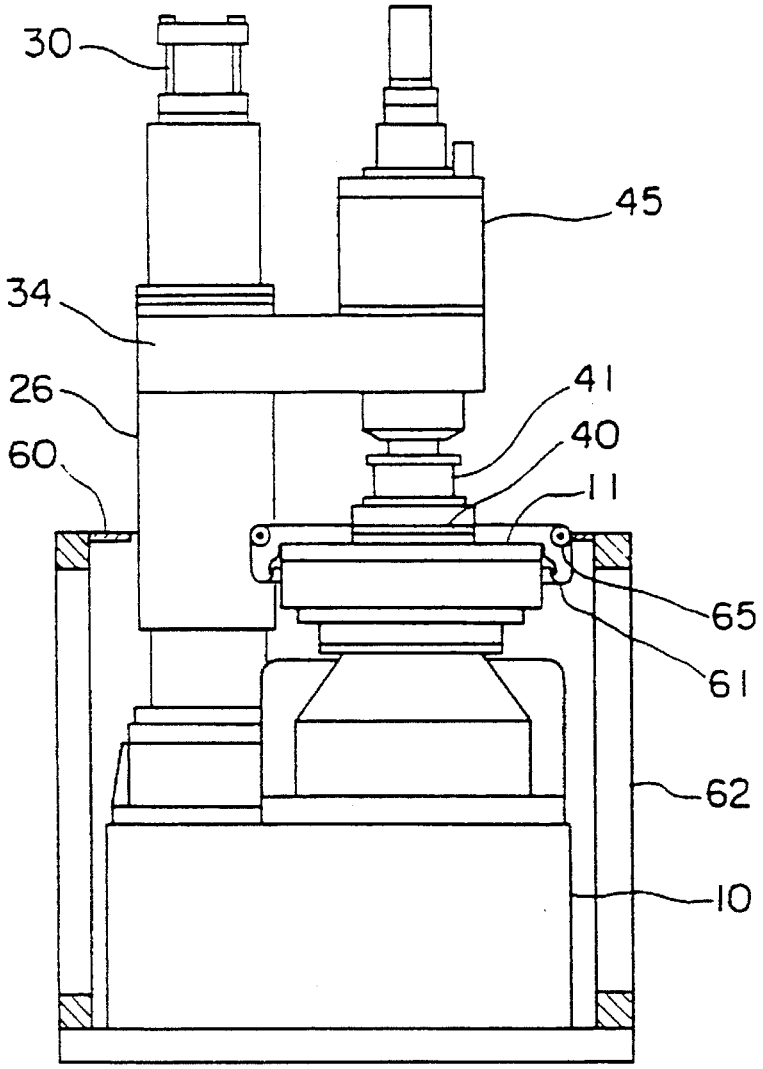
FIG. 3 is a side view, partly in section, of a third embodiment of the invention.
Figure 4:
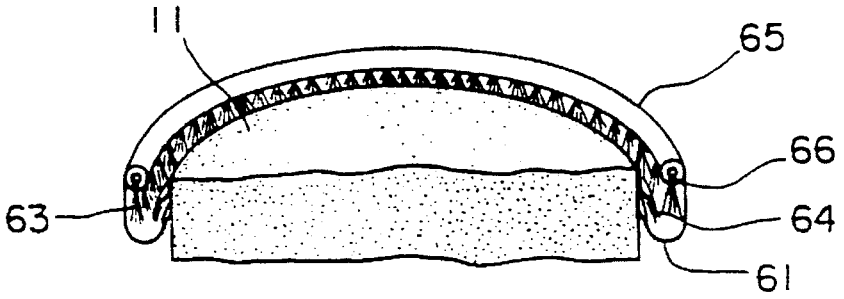
FIG. 4 is a perspective view showing an essential portion of the third embodiment in an enlarged scale.

FIGS. 3 and 4 show a third embodiment according to the present invention. In this embodiment is provided a prevention device for preventing the polishing liquid remaining in a polishing liquid receiver at the time of finishing a polishing operation, from being dried, solidified and scattering as dust.

Namely, along the outer periphery of the lower frame 10 of the polishing device is provided a frame 62 so as to enclose it, and to the upper end portion of the frame 62 at a level somewhat higher than the surface table 11 is horizontally secured a ring-like table 60. A trough-like polishing liquid receiver 61 is fitted to the inner periphery of the table 60 along the outer circumference of the surface table 11.

A flush water supply pipe 65 provided with a number of small apertures is disposed at the inner circumference of the table 60 along the outer circumference of the surface table 11, so that flush water 63 supplied from a flush water supply source (not shown) flows out into the polishing liquid receiver 61. In addition, a guide piece 64 inclined downwardly is attached to the circumferential edge of the surface table 11. At the bottom of the polishing liquid receiver 61 is provided a discharge port (not shown).

In the present embodiment, after finishing a polishing operation, a flow passage for polishing liquid is switched to a flush water supply passage, and flush water is supplied from the flush water supply source to the pipe 65. The flush water flows along the inner surface of the polishing liquid receiver 61 and washes away the polishing liquid adhering to or remaining on the inner surface of the polishing liquid receiver 61, which is then discharged from the discharge opening, and also after such discharge, any polishing liquid remaining therein is prevented from drying.

This prevents the polishing liquid from being dried and solidified after completion of a polishing operation, so, polishing powder contained in the polishing liquid is never blown up as dust.

As described above, the present invention provides advantageous effects in that the dust produced in the device can be suppressed, so that contaminating the work during a polishing operation by such dust comes to be considerably reduced, and because the reduced amount of dust released in the air, use of the device within a clean room is possible and, in addition, generation of vibration is suppressed to thereby allow polishing to be performed at a high level of precision.

What is claimed is:

1. A polishing device which comprises:

a surface table for polishing arranged horizontally;

surface table rotation drive means for rotating the surface table provided with a first built-in type motor connected to the surface table;

polishing head arranged for rotation above said surface table;

polishing head rotating means for rotating the polishing head provided with a second built-in type motor connected to the polishing head;

an arm for rotatably supporting said polishing head;

polishing head lifting means for driving in up and down motion said polishing head relative to said surface table, where the polishing head lifting means is connected to an upper portion of the polishing head;

arm swinging means for swinging said arm in the horizontal plane, where the arm swinging means is comprised of a first column provided vertically at a lateral side of the surface table and mounted for rotation about an axis of rotation parallel to that of the surface table, a second column which engages the outer circumference of the first column so that rotation of the first column can be transmitted to the second column, said second column holds the arm in the horizontal direction;

first column rotation drive means for driving the first column in rotation is provided with a motor directly connected to the first column; and said surface table rotation drive means and said polishing head rotating means each containing an outer periphery which is closed in a sealed condition.

2. The polishing device claimed in claim 1, wherein said polishing head lifting means is arranged at the upper portion of said first column and adapted to move said second column up and down along said first column.

3. The polishing device claimed in claim 1, further comprising:

a polishing liquid receiving member arranged at a level lower than an outer circumference of said surface table, so that a continuous supply of flush water is provided into said polishing liquid receiving member.

4. The polishing device claimed in claim 1, further comprising:

a hollow casing secured to an end of the arm;

a hollow shaft supported rotatably within the hollow casing, where the hollow shaft is driven by the second built-in type motor;

a shaft inserted co-rotatably and slidably in an axial direction within the hollow shaft, where the shaft is secured to the lower end of the polishing head;

a bearing cover through which a lower portion of the shaft is being penetrated outwardly and a bellows cover for connecting the bearing cover to the hollow casing; and said polishing head lifting means being connected to an upper portion of the shaft.

5. The polishing device claimed in claim 2, wherein the first column is rotatably fitted to a frame by means of bearings and the second column is formed to cover an exposed portion of the first column substantially over an entire length thereof and to cover a cylindrical projection of the frame when a lower end of the second column is positioned near a lower limit thereof.

* * * * *